US010310405B2

(12) United States Patent
Esumi

(10) Patent No.: US 10,310,405 B2
(45) Date of Patent: Jun. 4, 2019

(54) IMAGE FORMING APPARATUS AND RECORDING MEDIUM FOR CORRECTING DOT POSITION

(71) Applicant: Konica Minolta, Inc., Tokyo (JP)

(72) Inventor: Yoshihiro Esumi, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/874,568

(22) Filed: Jan. 18, 2018

(65) Prior Publication Data

US 2018/0203374 A1 Jul. 19, 2018

(30) Foreign Application Priority Data

Jan. 18, 2017 (JP) ..... 2017-006784

(51) Int. Cl.
*G03G 15/00* (2006.01)
*G03G 15/043* (2006.01)
*G03G 15/04* (2006.01)

(52) U.S. Cl.
CPC ..... *G03G 15/043* (2013.01); *G03G 15/0409* (2013.01); *G03G 15/04072* (2013.01)

(58) Field of Classification Search
CPC ..... G03G 15/04072; G03G 15/0409; G03G 15/043
See application file for complete search history.

(56) References Cited

U.S. PATENT DOCUMENTS 8,531,497 B2 * 9/2013 Motoyama ..... G03G 15/0415 347/243
2002/0085241 A1 * 7/2002 Izumiya ..... H04N 1/053 358/410
2004/0036757 A1 * 2/2004 Yoshida ..... H04N 1/053 347/132
2004/0246329 A1 * 12/2004 Yoshida ..... G03G 15/043 347/237
2007/0115339 A1 * 5/2007 Matsuzaki ..... B41J 2/473 347/118
2008/0285095 A1 * 11/2008 Iwamoto ..... B41J 2/471 358/481
2009/0034039 A1 * 2/2009 Moriwaki ..... G02B 26/128
(Continued)

FOREIGN PATENT DOCUMENTS

JP 2002-267961 A 9/2002
JP 2003-140068 A 5/2003

*Primary Examiner* — Francis C Gray
(74) *Attorney, Agent, or Firm* — Osha Liang LLP

(57) ABSTRACT

An image forming apparatus includes: an image carrier on which an image is formed; a light source that generates a light beam; an optical scanner that executes scanning of the light beam; a reflection surface identifier that identifies each reflection surface of a rotary polygon mirror; a sub-scanning direction driver that relatively moves the image carrier and the light beam to each other; a storage that stores first jitter information; a photodetector that detects scanning of the light beam; a measurement device that generates second jitter information; and a hardware processor that uses the first and second jitter information to change a frequency of a write clock and adjust a phase of the write clock, wherein the hardware processor obtains a correction characteristic for a dot position shift, and changes the frequency of the write clock and adjusts the phase of the write clock.

11 Claims, 10 Drawing Sheets

(56) References Cited

U.S. PATENT DOCUMENTS

| | | | | |
|---|---|---|---|---|
| 2010/0045767 | A1* | 2/2010 | Nihei | G03G 15/326 347/235 |
| 2011/0164273 | A1* | 7/2011 | Masui | G03G 15/043 358/1.14 |
| 2011/0221739 | A1* | 9/2011 | Masui | H04N 1/053 345/213 |
| 2013/0229696 | A1* | 9/2013 | Takikawa | G03G 15/043 358/474 |

* cited by examiner

IMAGE FORMING APPARATUS AND RECORDING MEDIUM FOR CORRECTING DOT POSITION

CROSS-REFERENCE TO RELATED APPLICATIONS

The entire disclosure of Japanese patent Application No. 2017-006784, filed on Jan. 18, 2017, is incorporated herein by reference in its entirety.

BACKGROUND

Technical Field

The present invention relates to an image forming apparatus such as a copying machine or a printer that uses an optical scanner including a rotary drive source and a rotary polygon mirror to execute scanning of a laser beam, and an image forming control program.

Description of the Related Art

An image forming apparatus is known that executes image formation of a predetermined number of lines in a main scanning direction with a light beam according to image data, and repeats image formation of the light beam for each predetermined number of lines, in the main scanning direction in a sub-scanning direction, to execute image formation for one page.

As an example, in an electrophotographic image forming apparatus, an optical scanner including a rotary drive source (polygon motor) and a rotary polygon mirror (polygon mirror) is used, and scanning is executed of a laser beam emitted in accordance with image data, in the main scanning direction, and in parallel with this, an image is formed by the laser beam on an image carrier (photosensitive member) rotating in the sub-scanning direction. In this case, the laser beam is emitted in accordance with the image data, using a clock signal (write clock) called a dot clock as a reference.

Due to a slight rotation irregularity of the polygon motor and a minute reflection surface accuracy error of the polygon mirror, jitter (fluctuation in the time axis direction) is generated in the laser beam scanning the image carrier, and a so-called short period jitter phenomenon occurs. Hereinafter, the short period jitter is simply referred to as jitter.

Due to the jitter, a dot position shift in the main scanning direction is periodically generated for each reflection surface of the polygon mirror (see FIG. 11), and due to interference with a screen image, the dot position shift becomes easy to be visually recognized as image quality degradation such as a horizontal stripe (see FIG. 12).

FIG. 11 schematically illustrates the shift in the main scanning direction of each reflection surface of six-sided rotary polygon mirror. In this case, as illustrated in FIG. 11, main scanning direction ends formed on the image carrier by the reflection surfaces #1 to #6 of the rotary polygon mirror are at different positions, respectively. When image formation of an oblique line is executed by such a dot group having variation, image quality degradation occurs, such as cyclic fluctuation as illustrated in FIG. 12.

To suppress image quality degradation, for example, various means are described in JP 2002-267961 A and JP 2003-140068 A.

To realize high image quality with such an image forming apparatus, it is important to align main scanning direction start positions and main scanning direction end positions of laser beams, that is, to uniform main scanning lengths between the laser beams to eliminate the shift in the main scanning direction.

In JP 2002-267961 A, a frequency of a write clock is adjusted for each surface of a polygon mirror with a Start Of Scan (SOS) signal on the start position side in the main scanning direction and an End Of Scan (EOS) signal on the end position side in the main scanning direction, whereby the main scanning length is controlled to be constant. Accordingly, by aligning the main scanning direction start positions and end positions, an error is eliminated in a part corresponding to the outer frame of the image. However, as illustrated in FIG. 13, an error due to flatness of the polygon mirror reflection surface remains in a part between the start position and the end position in the main scanning direction.

In JP 2003-140068 A, jitter information is stored in advance in a plurality of positions in the main scanning direction for each surface of the polygon mirror, a correction characteristic approximated by a straight line is obtained for the dot position shift at a plurality of positions generated in accordance with jitter on each surface, and the frequency and phase of the write clock are adjusted in accordance with the correction characteristic. In FIG. 14, the slope of the correction characteristic corresponds to the frequency of the write clock, and the intercept of the correction characteristic (the value of the vertical axis at the position of the horizontal axis 0) corresponds to the phase of the write clock. In this case, it has been thought that relatively satisfactory correction is possible, but it has been found that it is not possible to cope with a change with time of the jitter.

For example, it has been found that, in a case of a polygon mirror that continues to rotate at high speed, a change with time occurs in the flatness of the reflection surface due to difference in centrifugal force acting at each position of the reflection surface. In this way, it has become clear that the change with time of the jitter occurs; however, it has been found that the method of JP 2003-140068 A cannot cope with the change with time.

SUMMARY

One or more embodiments of the present invention realize an image forming apparatus and an image forming control program capable of suppressing a dot position shift in the main scanning direction in image formation using an optical scanner including a polygon motor and a polygon mirror, not only in a partial area but also in an entire main scanning area, while including a change with time.

An image forming apparatus of one or more embodiments of the present invention comprises: an image carrier on which an image is formed by exposure by a light beam; a light source that generates the light beam emitting light in accordance with image data in synchronization with a write clock; an optical scanner that executes scanning of the light beam in a main scanning direction on the image carrier by a plurality of reflection surfaces of a rotary polygon mirror rotationally driven by a rotary drive source; a reflection surface identifier that identifies each reflection surface of the rotary polygon mirror; a sub-scanning direction driver that relatively moves the image carrier and the light beam to each other in a sub-scanning direction orthogonal to the main scanning direction; a storage that stores first jitter information of the light beam measured at a plurality of positions in the main scanning direction on each reflection surface of the rotary polygon mirror; a photodetector that detects scanning of the light beam at a start position and an end position in the main scanning direction; a measurement device that generates second jitter information according to a scanning time from the start position to the end position in the main scanning direction of each reflection surface of the rotary polygon mirror in accordance with a detection result of the photodetector; and a hardware processor that uses the first jitter information and the second jitter information to change a frequency of the write clock and adjust a phase of the write clock, wherein the hardware processor corrects the first jitter information in accordance with a difference between the first jitter information and the second jitter information at an end of a corresponding reflection surface to obtain a correction characteristic for a dot position shift for each reflection surface of the rotary polygon mirror, and changes the frequency of the write clock and adjusts the phase of the write clock, in accordance with the correction characteristic.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, embodiments of the present invention will be described in detail with reference to the drawings. However, the scope of the invention is not limited to the disclosed embodiments.

An image forming apparatus of one or more embodiments of the present invention executes scanning of a light beam emitted in accordance with image data in a main scanning direction of an image carrier, and executes driving such that the image carrier and the light beam are relatively moved to each other in a sub-scanning direction orthogonal to the main scanning direction, to expose an image carrier surface to execute image formation. An optical scanner of one or more embodiments of the present invention includes a rotary drive source (polygon motor) and a rotary polygon mirror (polygon mirror), and is used for scanning of a light beam in the image forming apparatus.

[Configuration of Image Forming Apparatus]

Figure 1:
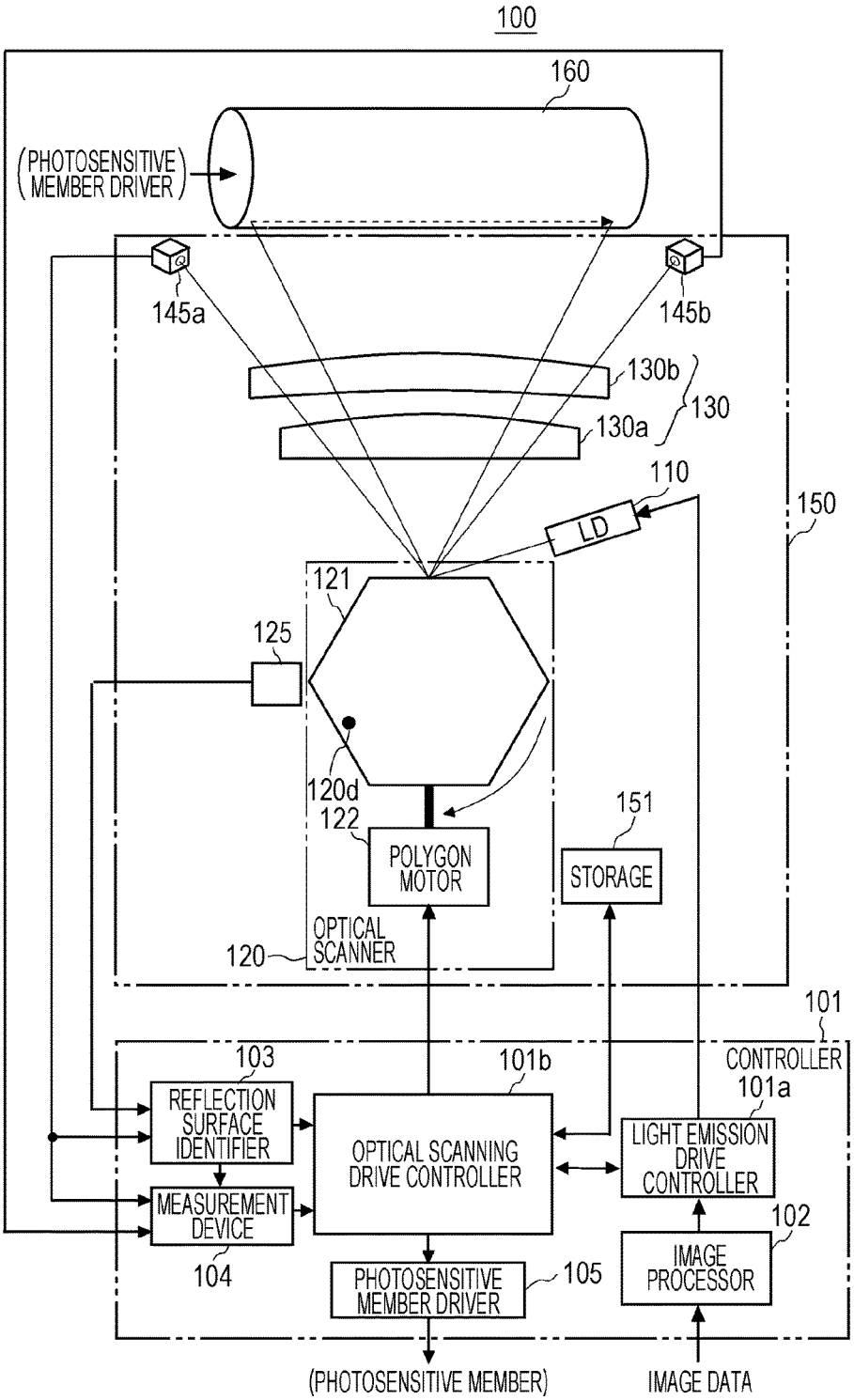
FIG. 1 is a block diagram illustrating a configuration of an image forming apparatus according to one or more embodiments of the present invention.

Hereinafter, a configuration of the image forming apparatus will be briefly described. An electrical configuration of an image forming apparatus 100 of one or more embodiments of the present invention will be described in detail with reference to FIG. 1. Here, the image forming apparatus 100 will be described in a state of forming a monochrome image, in a state related to a measuring apparatus 200 to be described later. The constituent elements necessary for describing one or more embodiments of the present invention will be mainly described, and description will be omitted of constituent elements that are generally used and well-known in image forming apparatuses.

A controller 101 includes a device that executes a control program, such as a CPU or a processor, for controlling each part of the image forming apparatus 100. In a case where, in addition to normal image forming operation, jitter information of the light beam measured at a plurality of positions in the main scanning direction for each reflection surface of a polygon mirror 121 is stored in advance in the storage, the controller 101 executes control to refer to the jitter information read from the storage to obtain a correction characteristic approximated by a straight line for a dot position shift at each of the plurality of positions generated in accordance with jitter on each surface of the polygon mirror 121, and change a frequency of a write clock and adjust a phase of the write clock, in accordance with the correction characteristic.

A laser diode (LD) 110 is a light source that generates a laser beam (light beam) that executes exposure while scanning a photosensitive member. The laser beam from the LD 110 may be a single beam or a plurality of beams.

An optical scanner 120 includes the polygon mirror 121 as a rotary polygon mirror and a polygon motor 122 as a rotary drive source. The polygon mirror 121 is the rotary polygon mirror that executes scanning of the laser beam in the main scanning direction on the photosensitive member surface by a plurality of rotating reflection surfaces. The polygon motor 122 is the rotary drive source that receives a polygon drive signal to rotate the polygon mirror 121 at a predetermined rotation speed.

A surface detection sensor 125 detects a reference mark 120*d* attached to the polygon mirror 121 to generate a surface detection signal for reflection surface identification, and transmits the surface detection signal to a reflection surface identifier 103.

An optical system 130 includes various optical members such as a cylindrical lens 130*a* and an f-O lens 130*b* for executing optical processing such that the laser beam emitted from the LD 110 and reflected by the polygon mirror 121 has a predetermined main scanning speed on the photosensitive member surface.

A photodetector 145 includes a photodetector 145*a* that detects scanning of the light beam at a start position in the main scanning direction, and a photodetector 145*b* that detects scanning of the light beam at an end position in the main scanning direction. The photodetector 145*a* on the start position side in the main scanning direction is a Start Of Scan (SOS) sensor that detects the light beam at the start position in the main scanning direction on an extension line of a main scanning position on a photosensitive member 160, to obtain a SOS signal, and a detection result is transmitted to the reflection surface identifier 103 and a measurement device 104 in the controller 101. The photodetector 145*b* on the end position side in the main scanning direction is an End Of Scan (EOS) sensor that detects the light beam at the end position in the main scanning direction on the extension line of the main scanning position on the photosensitive member 160, to output an EOS signal, and a detection result is transmitted to the measurement device 104 in the controller 101.

A print head 150 includes the LD 110, the optical scanner 120, the optical system 130, the photodetector 145, to execute scanning of the laser beam onto the photosensitive member, and is provided correspondingly to each color in a color image forming apparatus to be described later. The print head 150 can be configured in a unit type or the like to be replaceable by insertion and removal or the like with respect to the image forming apparatus 100, as necessary.

A storage 151 is a storage device that stores the jitter information of the light beam measured at the plurality of positions in the main scanning direction for each reflection surface of the polygon mirror 121, as first jitter information, which is measured in advance by the measuring apparatus 200 to be described later.

The photosensitive member 160 is an image carrier on which an electrostatic latent image according to the image data is formed on the surface, by exposure by the laser beam scanning in the main scanning direction by the rotation of the polygon mirror 121 and by relative movement to the light beam in the sub-scanning direction orthogonal to the main scanning direction, and the electrostatic latent image is developed and a toner image is formed. Charging for forming the electrostatic latent image, toner image formation by development of the electrostatic latent image, transfer of the toner image to recording paper, fixing of the toner image on the recording paper, and the like are generally used in the image forming apparatus 100, so that description is omitted.

The controller 101 includes a light emission drive controller 101*a*, an optical scanning drive controller 101*b*, an image processor 102, the reflection surface identifier 103, the measurement device 104, and a photosensitive member driver 105.

The light emission drive controller 101*a* is a drive source that generates a light emission drive signal for driving the LD 110 to emit light to supply the signal to the LD 110, and supplies a light emission drive signal according to the image data to the LD 110.

The optical scanning drive controller 101*b* is a drive signal generator that generates the polygon drive signal for rotationally driving the polygon mirror 121 at the predetermined rotation speed to supply the signal to the polygon motor 122.

The optical scanning drive controller 101*b* uses the first jitter information read from the storage 151 and the second jitter information obtained by measurement, to obtain a correction characteristic approximated by a straight line for the dot position shift at the plurality of positions generated in accordance with the jitter on each surface of the rotary polygon mirror, and changes the frequency of the write clock and adjusts the phase of the write clock, in accordance with the correction characteristic. The optical scanning drive controller 101*b* supplies the write clock that has undergone frequency change and phase adjustment as described above to the light emission drive controller 101*a*.

The image processor 102 is an image processing device that executes various image processing necessary for image formation to the image data, and outputs necessary data to the light emission drive controller 101*a* in synchronization with the write clock.

The reflection surface identifier 103 receives the surface detection signal from the surface detection sensor 125 and the detection result from the photodetector 145, to identify the reflection surface of the polygon mirror 121, and transmits a reflection surface identification result such as the number of the surface from the reference mark 120*d*, to the optical scanning drive controller 101*b*.

The measurement device 104 generates the second jitter information according to a scanning time from the start position to the end position in the main scanning direction of each reflection surface of the polygon mirror 121 in accordance with the detection results by the photodetectors 145*a* and 145*b*, to transmit the information to the optical scanning drive controller 101*b*.

The photosensitive member driver 105 is a photosensitive member rotation driver that rotates the photosensitive member 160 in the sub-scanning direction at a predetermined rotation speed. The photosensitive member driver 105 drives the photosensitive member 160 to achieve a photosensitive member rotation speed according to an image forming speed determined by the optical scanning drive controller 101*b*.

Figure 2:
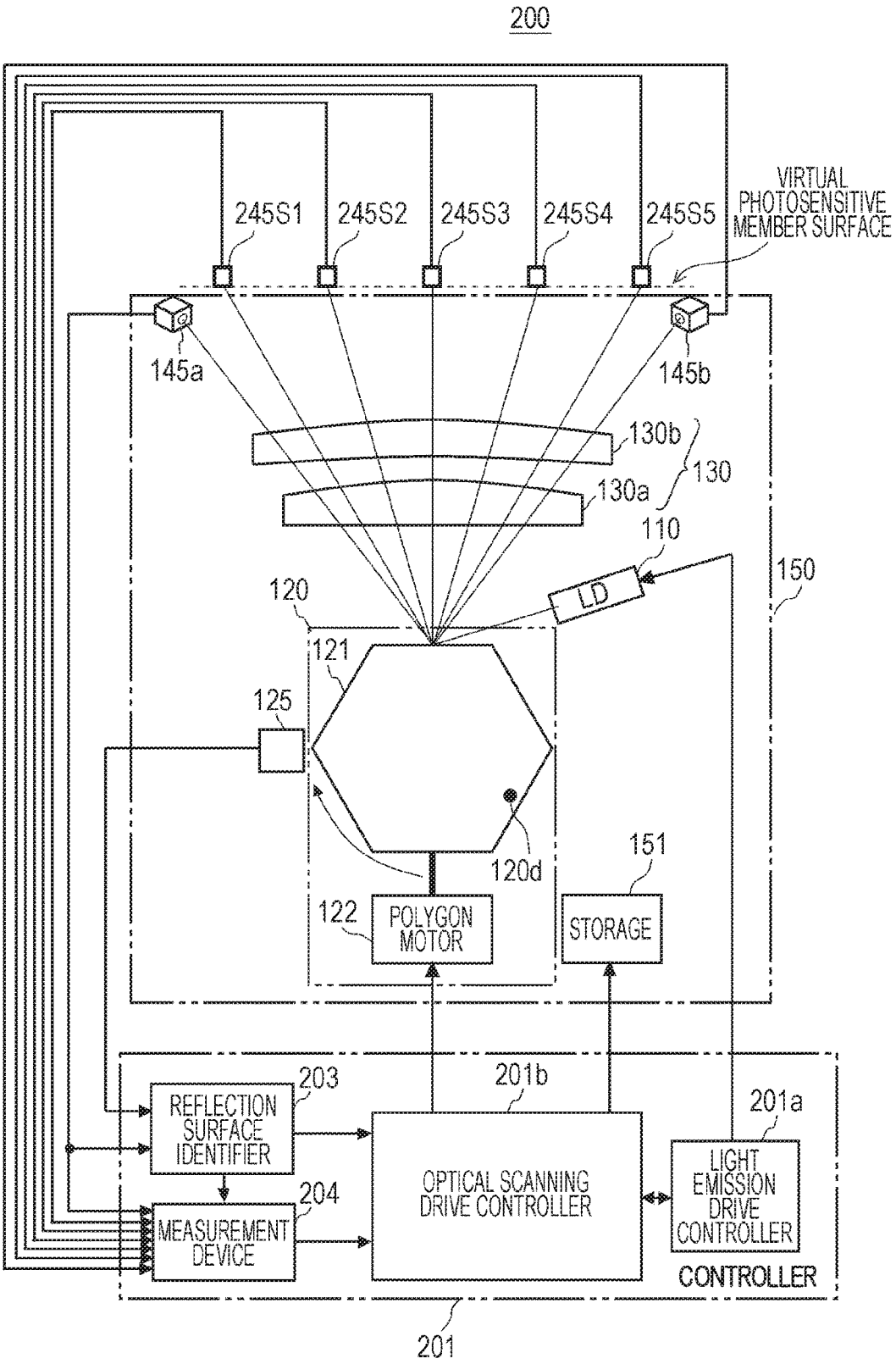
FIG. 2 is a block diagram illustrating a configuration of the image forming apparatus according to one or more embodiments of the present invention.
Figure 3:
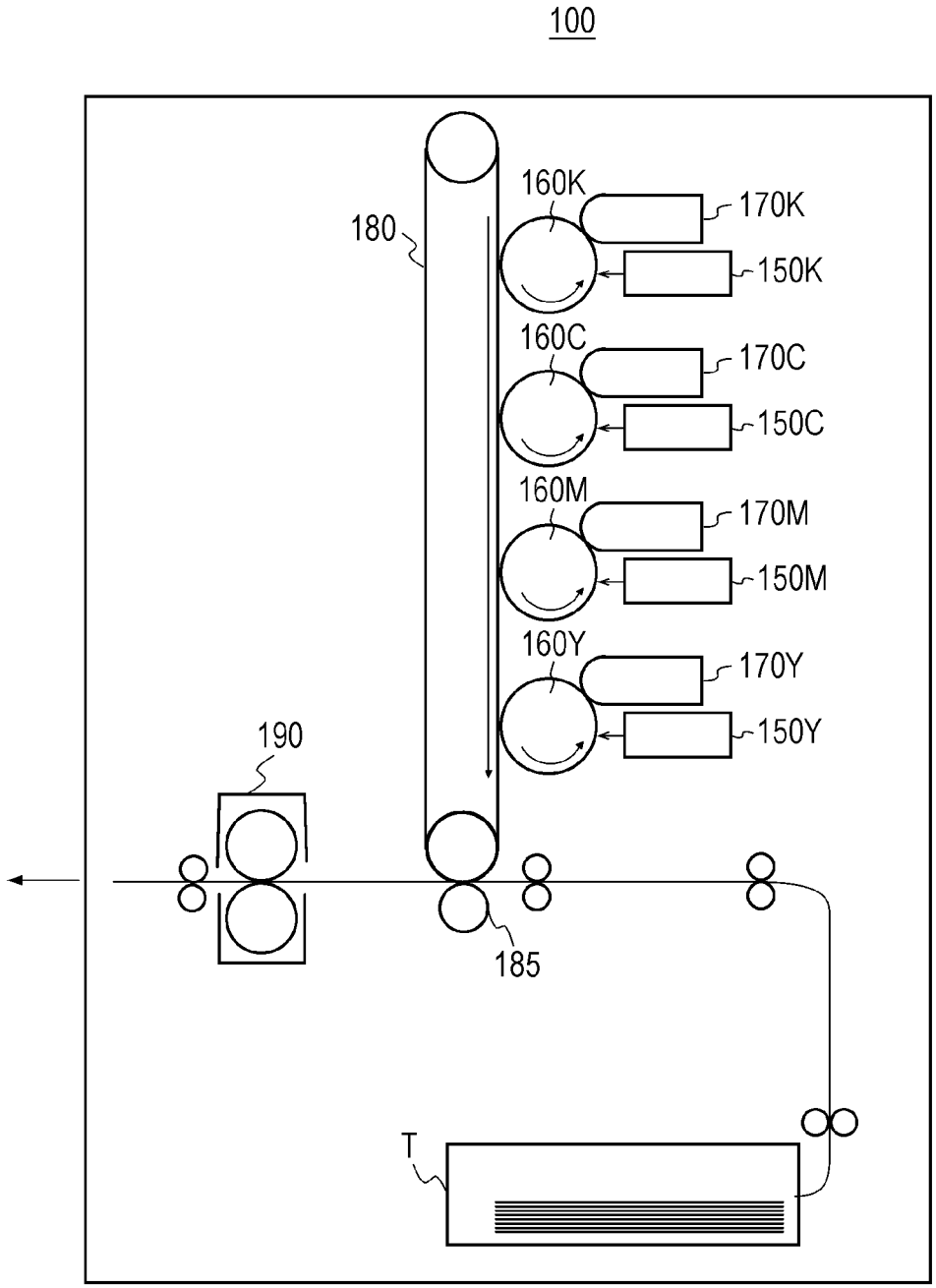
FIG. 3 is a block diagram illustrating a configuration of the image forming apparatus according to one or more embodiments of the present invention.

In a case where the image forming apparatus 100 is a color image forming apparatus that superimposes images of a plurality of colors to form a color image, as illustrated in FIGS. 2 and 3, print heads 150Y to 150K and photosensitive members 160Y to 160K are arranged in accordance with the plurality of colors, and the controller 101 is configured in common. FIGS. 2 and 3 illustrate a case where image formation is executed with four colors of yellow Y, magenta M, cyan C, and black K. The electrostatic latent images formed on the photosensitive members 160Y to 160K by the print heads 150Y to 150K are converted into toner images of respective colors of Y, M, C, and K by the developing devices 170Y to 170K, and the toner images of the respective colors are superimposed on each other on an intermediate transfer member 180. A toner image on the intermediate transfer member 180 is transferred onto the recording paper from a sheet feed tray T by a transfer device 185, and the toner image on the recording paper is thermally fixed by a fixing device 190 and a stable color image is formed. In the image forming apparatus 100, the print heads 150Y to 150K respectively include the optical scanners 120 in a state where characteristics of main scanning length are matched with each other as described later.

[Configuration of Measuring Apparatus]

Figure 4:
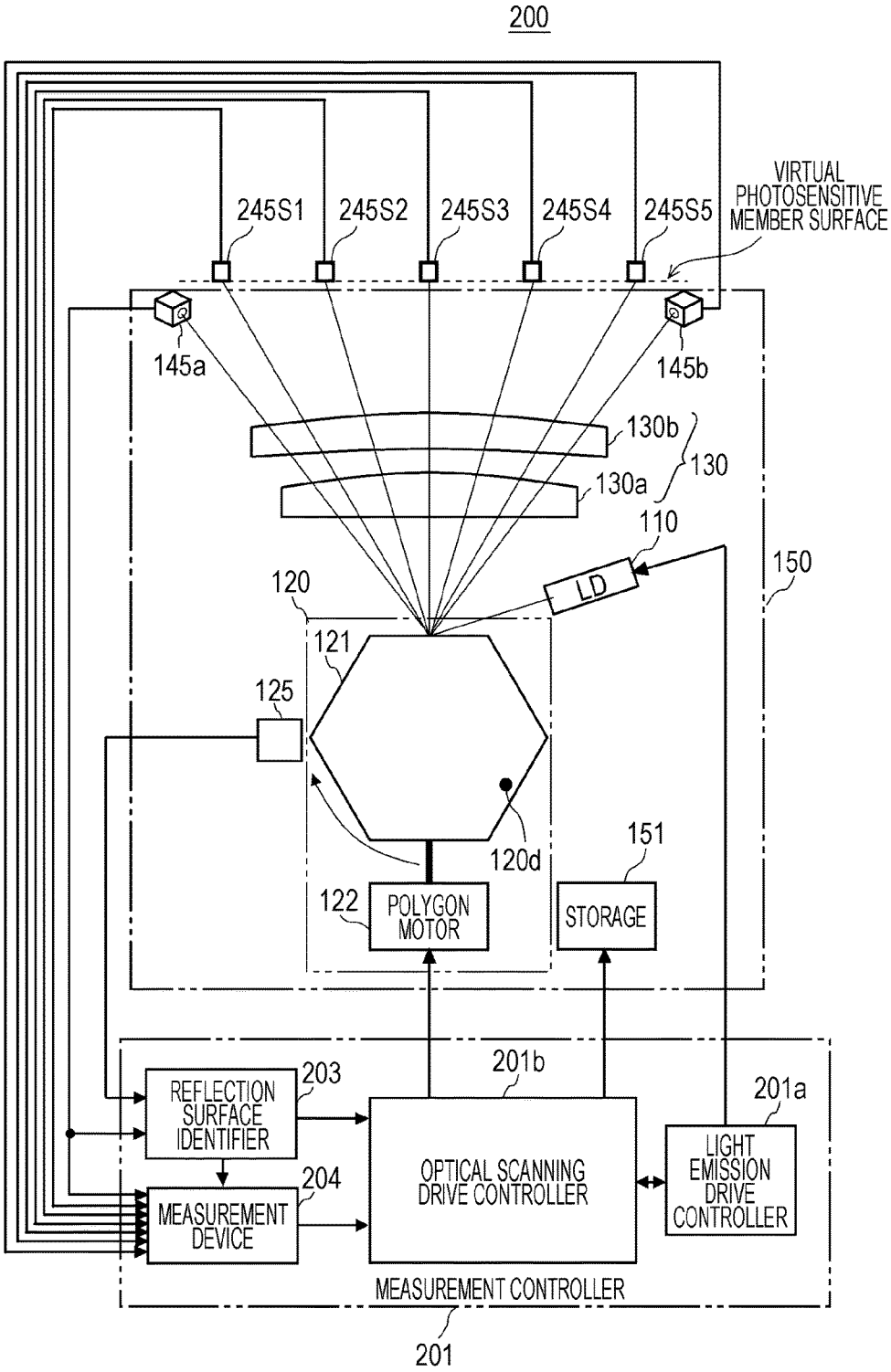
FIG. 4 is a block diagram illustrating a configuration of a measuring apparatus according to one or more embodiments of the present invention.

Hereinafter, the measuring apparatus 200 that measures the print head 150 will be described with reference to FIG. 4. A measurement procedure by the measuring apparatus 200 will be described, but measurement and adjustment similar to the following may be executed by an adjusting device (not illustrated) that executes other various adjustments.

The measuring apparatus 200 has characteristics that are mechanically or optically similar to those of the image forming apparatus 100 in which the print head 150 is used. The print head 150 can be mounted to the measuring apparatus 200 having characteristics that are mechanically or optically similar to those of the image forming apparatus 100 as described above.

A controller 201 includes a device that executes a control program, such as a CPU, or a processor, for controlling each part of the measuring apparatus 200, and executes control to obtain jitter information of the light beam measured at the plurality of positions in the main scanning direction for each reflection surface of the polygon mirror 121 included in the print head 150, as the first jitter information.

Each of photodetectors 245S1 to 245S5 is a sensor that detects a light beam and obtains a detection signal, at a position (virtual photosensitive member surface) optically equivalent to a main scanning position range of the photosensitive member 160 in the image forming apparatus 100, and a detection result is transmitted to a measurement device 204 in the controller 201.

The controller 201 includes a light emission drive controller 201*a*, an optical scanning drive controller 201*b*, a reflection surface identifier 203, and the measurement device 204.

The light emission drive controller 201*a* is a drive source that generates a light emission drive signal for driving the LD 110 to emit light to supply the signal to the LD 110, and supplies a light emission drive signal for the LD 110 to emit light at an end in the main scanning direction, to obtain a characteristic of main scanning length on each surface of the polygon mirror 121.

The optical scanning drive controller 201*b* executes control to generate a polygon drive signal for rotationally driving the polygon mirror 121 at a predetermined rotation speed equivalent to that of the image forming apparatus 100 to supply the signal to the polygon motor 122, and store the jitter information obtained by measurement as the first jitter information in the storage 151.

The reflection surface identifier 203 receives a surface detection signal from the surface detection sensor 125 and a detection result from the photodetector 145*a*, to identify the reflection surface of the polygon mirror 121, and transmits a reflection surface identification result such as the number of the surface from the reference mark 120*d*, to the optical scanning drive controller 201*b*.

The measurement device 204 refers to detection results by the photodetectors 245S1 to 245S5 on the virtual photosensitive member surface, to measure jitter (fluctuation in the time axis direction) in main scanning by the laser beam on each surface of the polygon mirror 121, and notifies the optical scanning drive controller 201*b* of jitter information that is a measurement result as the first jitter information.

[Measurement Procedure]

Hereinafter, a procedure (measuring operation) of measuring the first jitter information occurring in the print head 150 will be described with reference to a flowchart of FIG. 5.

Figure 5:
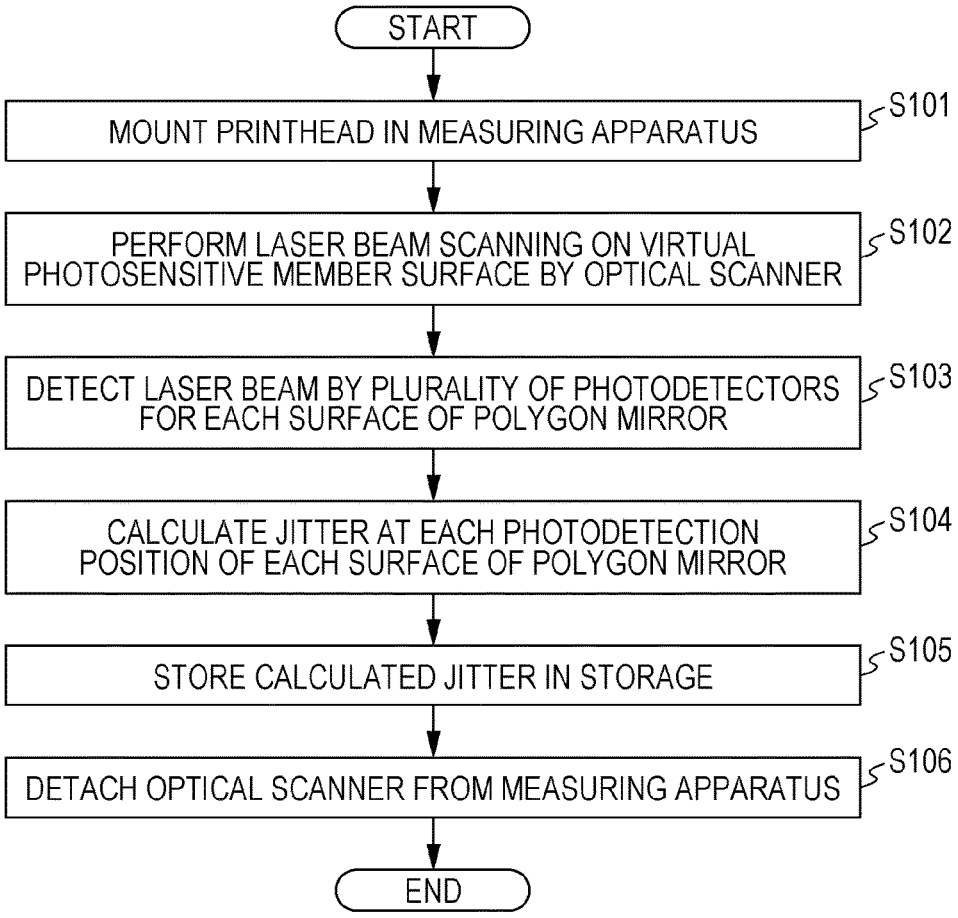
FIG. 5 is a flowchart illustrating a measurement procedure according to one or more embodiments of the present invention.

First, the print head 150 is mounted on the measuring apparatus 200 to be at the same position as a mounting position of the print head 150 in the image forming apparatus 100 (step S101 in FIG. 5).

The mounting means that predetermined installation and connection are executed mechanically and electrically. It is desirable that alignment and the like are completed for the print head 150 also in the measuring apparatus 200 side in advance such that each of the photodetectors 245S1 to 245S5 comes to a predetermined position in the virtual photosensitive member surface in a case where the print head 150 is mounted on the measuring apparatus 200.

With the print head 150 mounted on the measuring apparatus 200, the polygon motor 122 is rotated at a predetermined rotation speed in accordance with an instruction from the optical scanning drive controller 201*b*. In parallel with this, the light emission drive controller 201*a* generates the light emission drive signal to supply the signal to the LD 110, and causes the LD 110 to emit light on the virtual photosensitive member surface (step S102 in FIG. 5).

For each m-th surface of the polygon mirror 121, the measurement device 204 measures a time Tmn up to an output (sensor n signal) of the photodetector 245Sn, and a time Tm_eos up to the EOS signal output from the photodetector 145*b*, using the SOS signal output from the photodetector 145*a* as reference timing (step S103 in FIG. 5). In a specific example, a surface m of the polygon mirror 121 is one to six, and a sensor position n on the virtual photosensitive member surface is one to five. The numerical value can be appropriately changed in accordance with the image forming apparatus 100 to be used.

That is, for the first surface of the polygon mirror 121, the time T11 from the SOS signal to the output of the photodetector 245S1, . . . , the time T15 from the SOS signal to the output of the photodetector 245S5, and the time T1_eos from the SOS signal to the EOS signal are measured by the measurement device 204.

After that, in the same manner, the time T21, . . . , T25, and T2_eos on the second surface, the time T31, . . . , T35, and T3_eos on the third surface, the time T41, . . . , T45, and T4_eos on the fourth surface, the time T51, . . . , T55, and T5_eos on the fifth surface, and the time T61, . . . , T65, and T6_eos on the sixth surface are measured by the measurement device 204.

That is, on each reflection surface of the polygon mirror 121, the jitter information of the light beam measured at the plurality of positions in the main scanning direction (the start position and the end position in the main scanning direction, and one or more positions in between) is used as the first jitter information.

The optical scanning drive controller 201*b* receiving the measurement result from the measurement device 204, calculates the first jitter information as follows (step S104 in FIG. 5).

For example, it is assumed that jitter on the first surface of the polygon mirror 121 at the position of the photodetector 245S1 is RF11, . . . , and jitter on the sixth surface is RF61. In a case where an average value is Ave1 of the detection results T11, . . . , and T61 on the first surface to the sixth surface of the polygon mirror 121 at the photodetector 245S1, RF11=(T11−Ave1)/Ave1, . . . , and RF61=(T61−Ave1)/Ave1. Similarly, jitter RF12 to jitter RF62 on the first surface to the sixth surface at the position of the photodetector 245S2 are RF12=(T12−Ave2)/Ave2, . . . , and RF62=(T62−Ave2)/Ave2, respectively. Similarly, jitter RF13 to jitter RF63 on the first surface to the sixth surface at the position of the photodetector 245S3 are RF13=(T13−Ave3)/Ave3, . . . , and RF63=(T63−Ave3)/Ave3, respectively. Similarly, jitter RF14 to jitter RF64 on the first surface to the sixth surface at the position of the photodetector 245S4 are RF14=(T14−Ave4)/Ave4, . . . , and RF64=(T64−Ave4)/Ave4, respectively. Similarly, jitter RF15 to jitter RF65 on the first surface to the sixth surface at the position of the photodetector 245S5 are RF15=(T15−Ave5)/Ave5, . . . RF65=(T65−Ave5)/Ave5, respectively.

Similarly, in a case where an average value is Ave_eos of the detection results T1_eos, . . . , and T6_eos on the first surface to the sixth surface of the polygon mirror 121 at the photodetector 145*b*, jitter RF1_eos to jitter RF6_eos on the first surface to the sixth surface at the position of the photodetector 145*b* are RF1_eos=(T1_eos−Ave_eos)/Ave_eos, . . . , and RF6_eos=(T6_eos−Ave_eos)/Ave_eos, respectively.

For calculation of the jitter as described above, the optical scanning drive controller 201*b*, for example, executes measurement repeatedly for about 500 rotations of the polygon mirror 121 to execute averaging, thereby being able to suppress influence of noise and the like on the jitter RFmn and jitter RFm_eos.

In this way, when a total of 30 pieces of jitter information RFmn on the jitter at the five sensor positions of each of the six surfaces, and six pieces of RFm_eos of the respective six surfaces are calculated, the optical scanning drive controller 201*b* converts jitter RF to a shift amount Y. If the jitter RF is a negative value, it means that detection is earlier than the average, so that it means that if image formation of a dot is executed with an original dot clock, the dot is shifted to the main scanning direction downstream side. If the jitter RF is a positive value, it means that detection is later than the average, so that it means that if image formation of the dot is executed with the original dot clock, the dot is shifted to the main scanning direction upstream side.

That is, the optical scanning drive controller 201*b* calculates shift amounts Ymn and Ym_eos as the first jitter information from RFmn and RFm_eos obtained from the measurement result (step S104 in FIG. 5).

The optical scanning drive controller 201*b* stores the shift amounts Ymn and Ym_eos calculated from RFmn and RFm_eos obtained from the measurement result, as the first jitter information in the storage 151, in association with the corresponding measurement positions Xmn and Xm_eos (step S105 in FIG. 5).

In one or more embodiments of the present invention, five photodetectors 245S1 to 245S5 are arranged within one scan; however, it goes without saying that the number is not limited to five. An example is illustrated in which photodetectors 245S1 to 245S5 are arranged at equal intervals; however, the present invention is not limited to the example.

As described above, the print head 150 in which the first jitter information is written in the storage 151 is detached from the measuring apparatus 200 (step S106 in FIG. 5), and mounted in the image forming apparatus 100 as necessary. When a necessary number of the print heads 150 are measured, the above measurement processing is ended.

[Operation (1) of Image Forming Apparatus]

Hereinafter, a first operation example will be described of a normal operation of the image forming apparatus 100 according to one or more embodiments of the present invention. In the image forming apparatus 100, the print head 150 is mounted in which the first jitter information at the plurality of positions for each reflection surface of the polygon mirror 121 is written in the storage 151 as described above.

In a conventional method described in JP 2002-267961 A, attention is paid only to the jitter on the main scanning downstream side, and it corresponds to a case where attention is paid only to the jitter at the position of the sensor 245S5 in one or more embodiments of the present invention, so that it has not been able to cope with nonlinear jitter in a middle part. In a conventional method described in JP 2003-140068 A, the first jitter information measured at the positions of the sensors 245S1 to 245S5 is used, so that it has been possible to cope with the nonlinear jitter at the middle part, but it has not been able to cope with a change with time of the jitter.

Hereinafter, calculation will be described of jitter correction data in the image forming apparatus according to one or more embodiments of the present invention.

Figure 6:
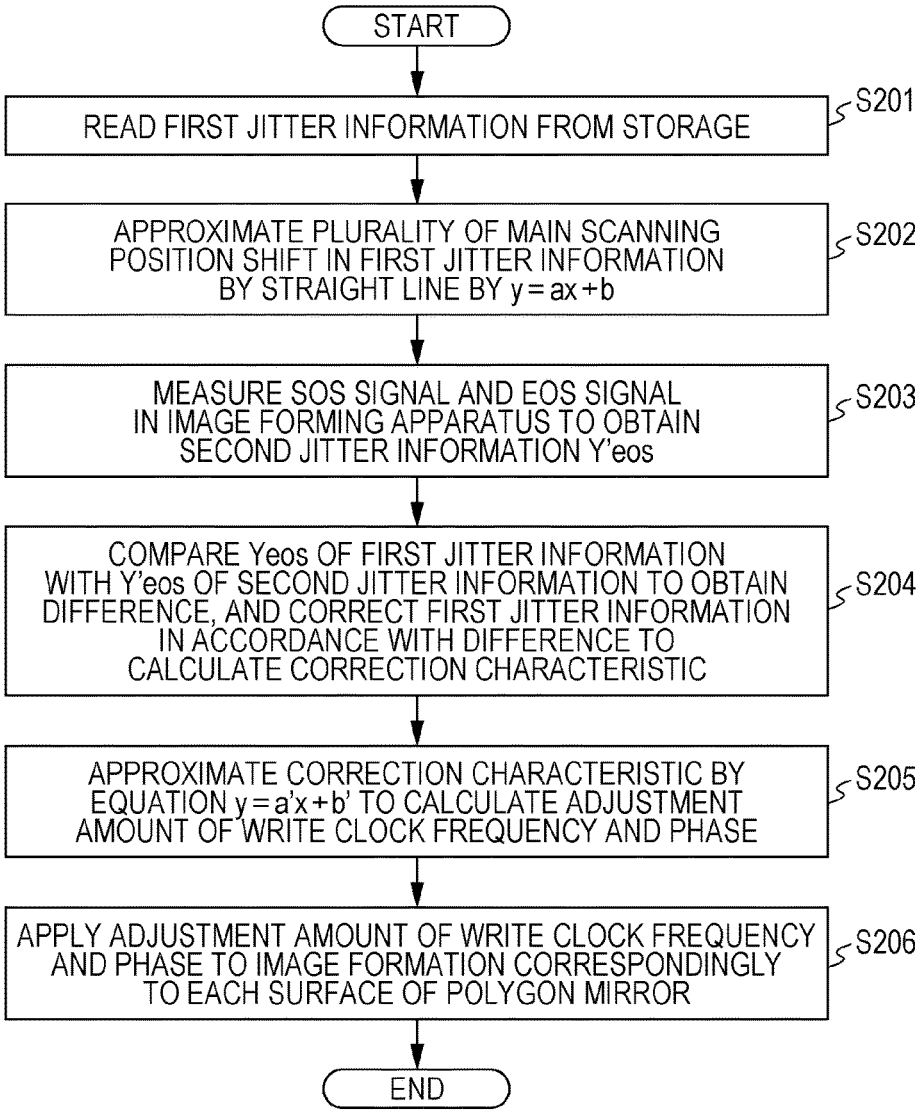
FIG. 6 is a flowchart illustrating an operation procedure of one or more embodiments of the present invention.

The optical scanning drive controller 101*b* reads Ymn and Ym_eos as the first jitter information for each surface m of the polygon mirror 121 from the storage 151 (step S201 in FIG. 6).

Figure 7:
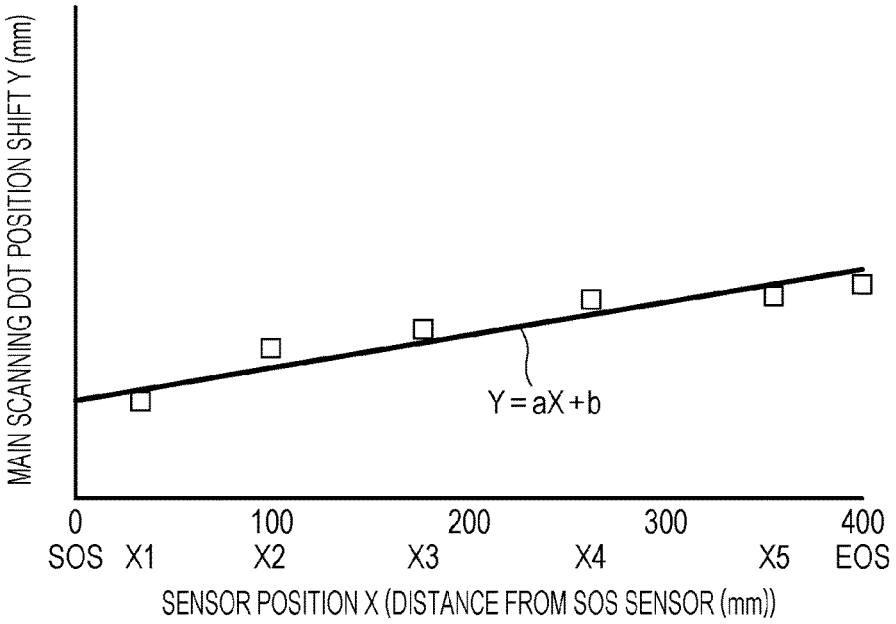
FIG. 7 is a characteristic diagram illustrating operation of the image forming apparatus according to one or more embodiments of the present invention.

On the basis of the first jitter information read, for each surface m of the polygon mirror 121, regarding the first jitter information, when a position in the main scanning direction is X and a dot position shift is Y, a position shift based on the first jitter information (outline square in FIG. 7) is approximated by a straight line by an approximation equation Ym=amX+bm, as illustrated by a solid line in FIG. 7 (step S202 in FIG. 6). The linear approximation may be executed based on a least squares method or the like for a plurality of main scanning dot position shifts.

In a case where an average value is Ave'_eos of detection results T'1_eos, . . . , and T'6_eos on the first surface to the sixth surface of the polygon mirror 121 at the photodetector 145*b* as the EOS sensor, when RF'1_eos=(T'1_eos−Ave'_eos)/Ave'_eos, . . . , and RF'6_eos=(T'6_eos−Ave'_eos)/Ave'_eos, the optical scanning drive controller 101*b* drives the print head 150 to obtain jitter RF'1_eos to jitter RF'6_eos on the first surface to the sixth surface at the position of the photodetector 145*b*. That is, the optical scanning drive controller 101*b* drives the print head 150 to obtain RF'm_eos on the m-th surface. The optical scanning drive controller 101*b* calculates a shift amount Y'm_eos as the second jitter information from RF'm_eos, for the m-th surface (step S203 in FIG. 6).

A difference between Ym_eos included in the first jitter information and Y'm_eos as the second jitter information corresponds to a change due to the change with time.

The optical scanning drive controller 101*b* compares Ym_eos included in the first jitter information read from the storage 151 with Y'm_eos as the second jitter information calculated at the present time, and corrects the first jitter information in accordance with a difference between the first jitter information and the second jitter information at an end of a corresponding reflection surface, to obtain a correction characteristic that can cope with the change with time for the dot position shift for each reflection surface (step S204 in FIG. 6).

A slope a'm of an equation approximating the shift amount in the correction characteristic is obtained as a'm=(Ym_eos'−Ym_eos)/Xm_eos+am. An intercept b'm of the equation approximating the shift amount in the correction characteristic is obtained as b'm=a'm*X1*m*+bm.

Figure 8:
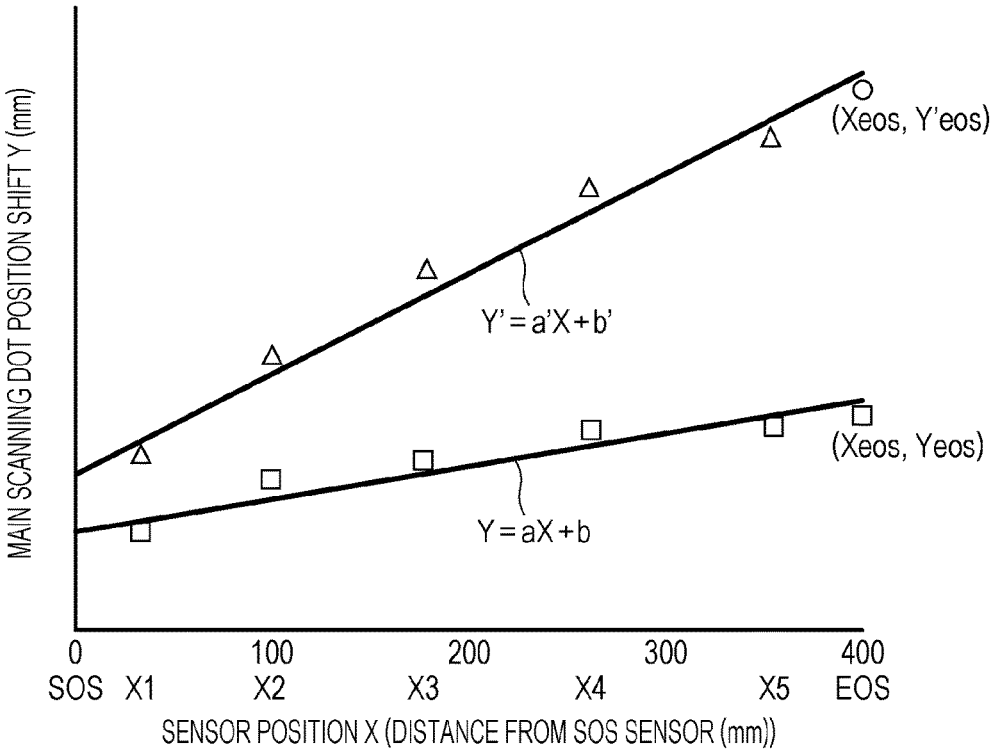
FIG. 8 is a characteristic diagram illustrating operation of the image forming apparatus according to one or more embodiments of the present invention.

The optical scanning drive controller 101*b* approximates the correction characteristic by a straight line by an approximation equation Y'm=a'mX+b'm as illustrated in FIG. 8, and changes the frequency of the write clock by a'm, and adjusts the phase of the write clock by b'm, for the m-th surface of the polygon mirror 121 (step S205 in FIG. 6).

That is, for the main scanning dot position shift at each of positions X1 to X5 on each surface m of the polygon mirror 121, on the basis of the approximation equation of the correction characteristic obtained, the optical scanning drive controller 101*b* applies frequency change and phase adjustment of the write clock such that the frequency of the write clock is corrected on the basis of a slope component a'm of the approximation equation of the correction characteristic Y'm=a'mX+b'm and the phase of the write clock is adjusted on the basis of an intercept component b'm, and supplies the write clock that has undergone the frequency change and the phase adjustment to the light emission drive controller 101*a* to execute image formation (step S206 in FIG. 6).

A relationship between the slope component a'm of the equation and a correction amount of the frequency of the write clock, and a relationship between the intercept component b'm and a phase adjustment amount of the write clock are obtained in advance. If the slope a'm is on the positive side, the shift amount is on the +side, so that the frequency is increased and the main scanning length is shortened, and if the intercept b'm is on the +side, the phase is advanced and the shift in the +side is eliminated.

With the above configuration, it is possible to suppress the dot position shift in the main scanning direction in image formation using the polygon mirror 121 not only in a partial area such as the end but also in an entire main scanning area while including the change with time.

In the above description, a case where m is omitted for the surface of the polygon mirror 121 and description is made as Y=aX+b for the approximation equation Ym=amX+bm of the first jitter information, also has the same meaning as in the embodiments described above. Similarly, a case where m is omitted and description is made as Y'=a'mX+b'm for Y'=a'X+b' as the correction characteristic, also has the same meaning as in the embodiments described above.

[Operation (2) of Image Forming Apparatus]

Hereinafter, a second operation example will be described of the normal operation of the image forming apparatus 100 according to one or more embodiments of the present invention. A description overlapping with the above-described operation (1) is omitted, and differences will be mainly described.

The optical scanning drive controller 101*b* reads Ymn and Ym_eos as the first jitter information for each surface m of the polygon mirror 121 from the storage 151. It is assumed that the first jitter information has already been measured at six points of (X1, Y1), (X2, Y2), (X3, Y3), (X4, Y4), (X5, Y5), and (Xeos, Yeos) on each surface of the polygon mirror 121. In one or more embodiments of the present invention, (Xeos, Yeos) is handled as (X6, Y6) next to (X5, Y5).

In the following description, since the position in the main scanning direction is divided into n parts, to simplify the sign, the description will be made in a state where m indicating each surface of the polygon mirror 121 is omitted in the equation.

Figure 9:
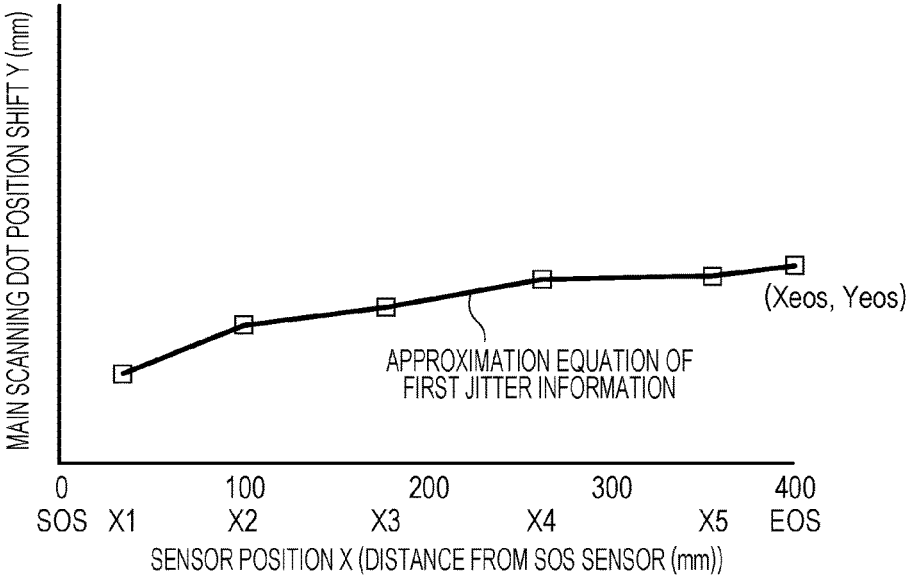
FIG. 9 is a characteristic diagram illustrating operation of the image forming apparatus according to one or more embodiments of the present invention.

For each surface m of the polygon mirror 121, when a position in the main scanning direction is Xn, a dot position shift is Yn, and a slope an at each of n positions Xn in the main scanning direction is an=(Yn+1−Yn)/(Xn+1−Xn), the optical scanning drive controller 101*b* approximates the position shift based on the first jitter information read (outline square in FIG. 9) by a polygonal line by an approximation equation of Yn=anXn.

Figure 10:
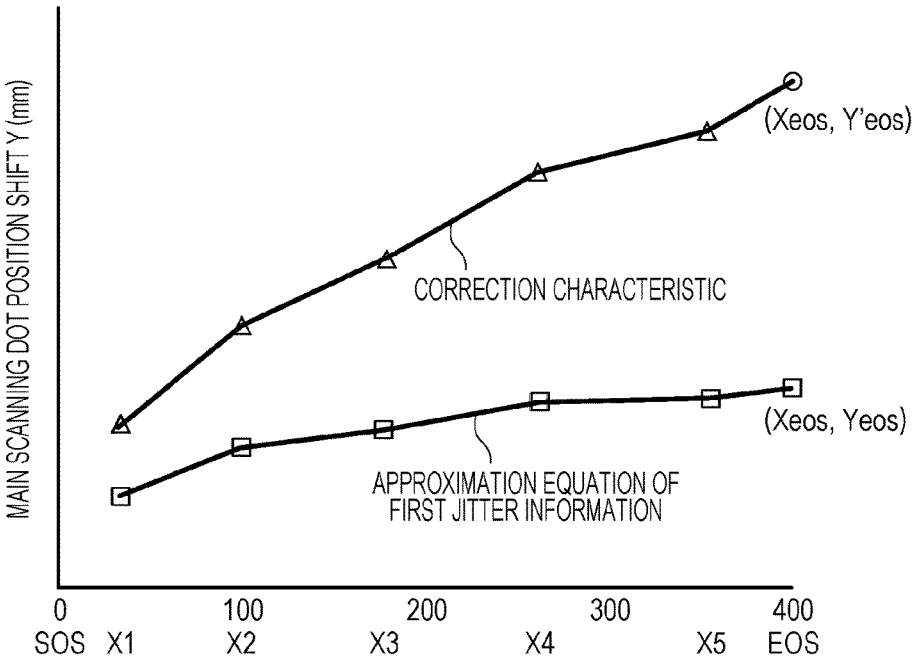
FIG. 10 is a characteristic diagram illustrating operation of the image forming apparatus according to one or more embodiments of the present invention.
Figure 11:
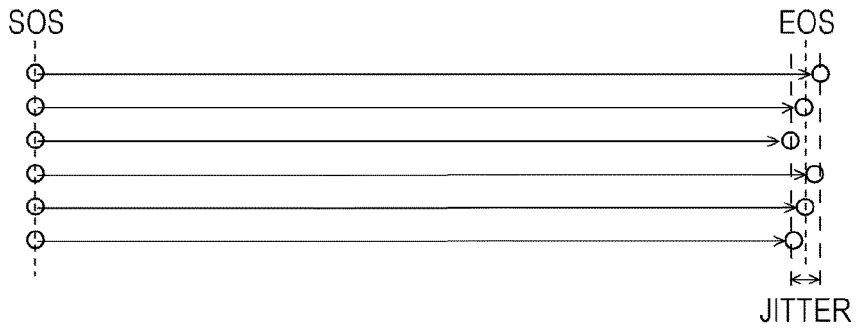
FIG. 11 is an explanatory diagram illustrating a characteristic of an image forming apparatus according to one or more embodiments of the present invention.
Figure 12:
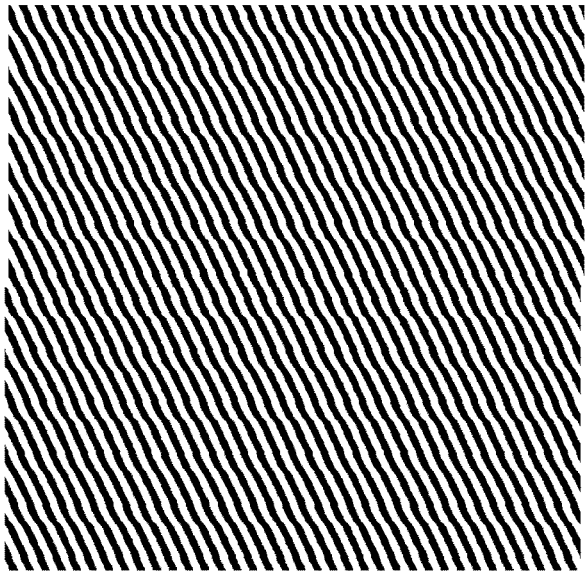
FIG. 12 is an explanatory diagram illustrating a characteristic of an image forming apparatus according to one or more embodiments of the present invention.
Figure 13:
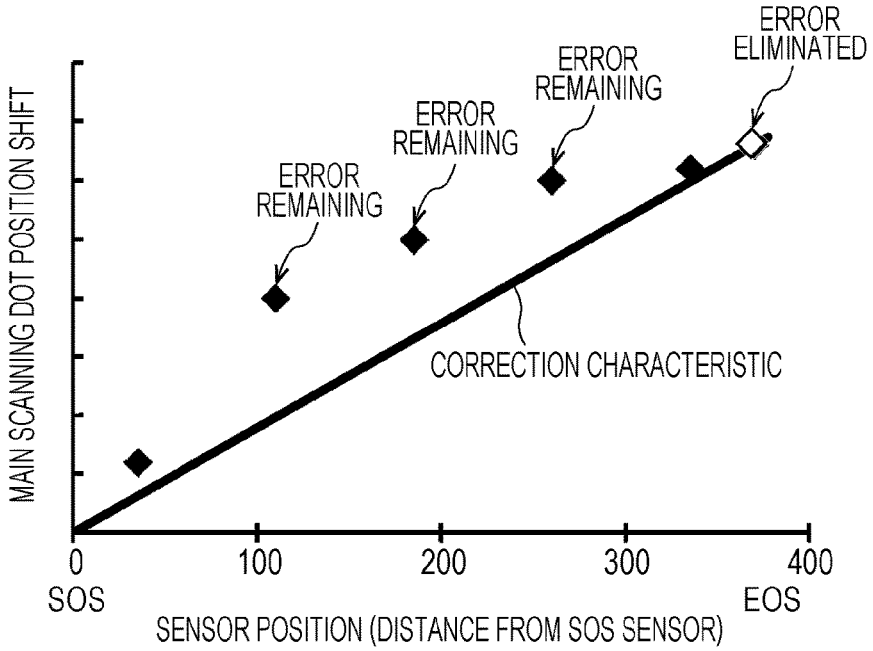
FIG. 13 is an explanatory diagram illustrating a characteristic of an image forming apparatus according to one or more embodiments of the present invention.
Figure 14:
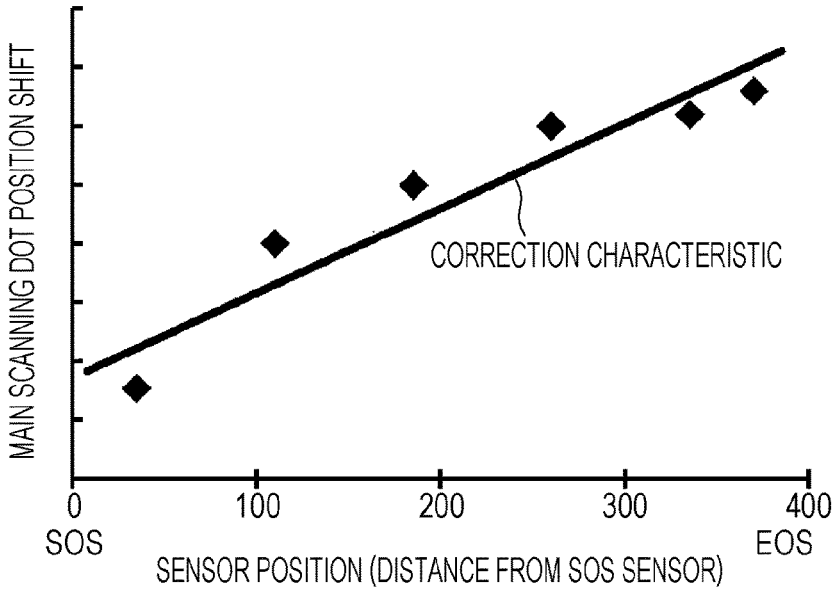
FIG. 14 is an explanatory diagram illustrating a characteristic of an image forming apparatus according to one or more embodiments of the present invention.

When the dot position shift according to the first jitter information at the end position Xeos in the main scanning direction is Yeos, a dot position shift according to the second jitter information at the end position Xeos in the main scanning direction is Y'eos, and a slope a'n of an approximation equation of the correction characteristic is a'n=(Y'eos/Yeos)*an, the optical scanning drive controller 101*b* approximates the correction characteristic by an approximation equation Y'=a'nXn as illustrated in FIG. 10, and changes the frequency of the write clock by a'n.

That is, for the main scanning dot position shift at each of positions X1 to X5 on each surface m of the polygon mirror 121, on the basis of the approximation equation of the correction characteristic obtained, to correct the frequency of the write clock on the basis of the slope component a'n of the approximation equation Y'=a'nXn of the correction characteristic, the optical scanning drive controller 101*b* supplies the write clock to which the frequency change of the write clock is applied, to the light emission drive controller 101*a* to execute image formation.

As described above, in a case where the approximation equation based on the first jitter information is divided into n parts in the main scanning direction and approximated by a slope an at each of n positions Xn in the main scanning direction, the slope a'n of the approximation equation of the correction characteristic is set to a'n=Y'eos/Yeos*an, whereby it is possible to suppress the dot position shift not only in the partial area such as the end but also in the entire main scanning area, in an appropriate state, while including the change with time.

Even when the dot position shift in the main scanning direction is not linear, the slope is changed for each of the plurality of positions, and the first jitter information and the correction characteristic are created, so that a residual is small on average overall. That is, instead of eliminating the dot position shift only in the partial area, the dot position shift in the main scanning direction can be minimized, and satisfactory image quality can be obtained.

With respect to the operation (2), control on the intercept may be executed as in the case of the operation (1), and control may be executed to adjust the phase of the write clock.

As illustrated in FIGS. 2 and 3, the image forming apparatus 100 includes an image former that executes image formation with a plurality of color materials respectively having different colors. In this case, it is desirable that the optical scanning drive controller 101*b* simultaneously obtains the correction characteristic in a plurality of colors used for image formation. This makes it possible to appropriately suppress the dot position shift, with the plurality of colors used for image formation, not only in the partial area such as the end but also in the entire main scanning area, in an appropriate state, while including the change with time.

When the image forming apparatus 100 is powered on, the optical scanning drive controller 101*b* obtains the correction characteristic, whereby it is possible to appropriately suppress the dot position shift not only in the partial area such as the end but also in the entire main scanning area, in the appropriate state, while including the change with time.

In a case where temperature in the image forming apparatus 100 changes to a certain level or more, in a case where image formation is executed for a predetermined time or more, or in a case where image formation is executed for more than a certain number of sheets, the optical scanning drive controller 101*b* obtains the correction characteristic for the above, whereby it is possible to appropriately suppress the dot position shift not only in the partial area such as the end but also in the entire main scanning area, in the appropriate state, while including the change with time.

When the difference between Ym_eos and Y'm_eos exceeds a predetermined threshold, the optical scanning drive controller 101*b* obtains the correction characteristic as the difference between the first jitter information and the second jitter information, whereby it is possible to appropriately suppress the dot position shift not only in the partial area such as the end but also in the entire main scanning area, in the appropriate state, while including the change with time.

In the above embodiments, the first jitter information related to the jitter measured in advance is stored in the storage 151, and the second jitter information is calculated by the actual image forming apparatus 100, so that it is possible to calculate multiple kinds of different correction data or execute different correction calculation, as necessary in the image forming apparatus 100 side.

In the above embodiments, an electrophotographic image forming apparatus using laser beam scanning has been described, but the present invention is not limited to the electrophotographic image forming apparatus. For example, one or more embodiments of the present invention can be applied to various image forming apparatuses such as a laser imager that uses laser beam scanning to execute exposure on photographic paper, and it is possible to obtain a satisfactory result.

In the above embodiments, a photosensitive drum is used as a specific example of the photosensitive member 160, but the photosensitive member 160 is not limited to the drum type, but may be a belt. With respect to the laser beam and the photosensitive member 160, not only rotation in the sub-scanning direction of the photosensitive member 160, but also various sub-scanning methods that relatively move the photosensitive member 160 and the laser beam to each other in the sub-scanning direction can be applied.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. An image forming apparatus comprising:

an image carrier exposed by a light beam to form an image on the image carrier;

a light source that generates the light beam emitted in accordance with image data in synchronization with a write clock;

an optical scanner that executes scanning of the light beam in a main scanning direction on the image carrier by a plurality of reflection surfaces of a rotary polygon mirror rotationally driven by a rotary drive source;

a reflection surface identifier that identifies each of the reflection surfaces of the rotary polygon mirror;

a sub-scanning direction driver that relatively moves the image carrier and the light beam to each other in a sub-scanning direction orthogonal to the main scanning direction;

a storage that stores a first jitter information of the light beam obtained by a measurement device before execution of a print job, wherein the first jitter information corresponds to a first scanning time up to each of a plurality of positions in the main scanning direction on each of the reflection surfaces of the rotary polygon mirror;

a photodetector that detects scanning of the light beam at a start position and an end position in the main scanning direction; and a hardware processor that:

generates a second jitter information based on a detection result of the photodetector after a start of the execution of the print job, wherein the second jitter information corresponds to a second scanning time from the start position to the end position in the main scanning direction on each of the reflection surfaces of the rotary polygon mirror, corrects the first jitter information based on a difference between the first jitter information and the second jitter information at an end of each of the reflection surfaces to obtain a correction characteristic for a dot position shift on each of the reflection surfaces of the rotary polygon mirror, and changes the frequency of the write clock and adjusts the phase of the write clock based on the correction characteristic.

2. The image forming apparatus according to claim 1, wherein the hardware processor:

when a position in the main scanning direction is X and a dot position shift is Y, approximates a position shift based on the first jitter information by a straight line by an approximation equation $Y = aX + b$;

when a dot position shift according to the first jitter information at an end position Xeos in the main scanning direction is Yeos, a dot position shift according to the second jitter information at the end position Xeos in the main scanning direction is Y'eos, a slope a' of an equation approximating a shift amount in the correction characteristic is $a' = (Y'eos - Yeos)/Xeos + a$, and an intercept b' of the equation approximating the shift amount in the correction characteristic is $b' = a' * X1 + b$, approximates the correction characteristic by a straight line by an approximation equation $Y' = a'X + b'$; and changes the frequency of the write clock by a', and adjusts the phase of the write clock by b'.

3. An image forming apparatus comprising:

an image carrier exposed by a light beam to form an image on the image carrier;

a light source that generates the light beam emitted in accordance with image data in synchronization with a write clock;

an optical scanner that executes scanning of the light beam in a main scanning direction on the image carrier by a plurality of reflection surfaces of a rotary polygon mirror rotationally driven by a rotary drive source;

a reflection surface identifier that identifies each of the reflection surfaces of the rotary polygon mirror;

a sub-scanning direction driver that relatively moves the image carrier and the light beam to each other in a sub-scanning direction orthogonal to the main scanning direction;

a storage that stores a first jitter information of the light beam obtained by a measurement device before execution of a print job, wherein the first jitter information corresponds to a first scanning time up to each of a plurality of positions in the main scanning direction on each of the reflection surfaces of the rotary polygon mirror;

a photodetector that detects scanning of the light beam at a start position and an end position in the main scanning direction; and a hardware processor that:

generates a second jitter information based on a detection result of the photodetector after a start of the execution of the print job, wherein the second jitter information corresponds to according to a second scanning time from the start position to the end position in the main scanning direction on each of the reflection surfaces of the rotary polygon mirror in accordance with a detection result of the photodetector, corrects the first jitter information in accordance with based on a difference between the first jitter information and the second jitter information at an end of a corresponding reflection surface among each of the reflection surfaces to obtain a correction characteristic for a dot position shift on each of the reflection surfaces of the rotary polygon mirror, and changes the frequency of the write clock based on the correction characteristic, when a position in the main scanning direction is Xn, a dot position shift is Yn, and a slope an at each of n positions Xn in the main scanning direction is an =(Xn+1−Yn)/(Xn+1−Xn), approximates a position shift, based on the first jitter information by an approximation equation Yn =anXn, and when a dot position shift according to the first jitter information at an end position Xeos in the main scanning direction is Yeos, a dot position shift according to the second jitter information at the end position Xeos in the main scanning direction is Y'eos, and a slope a'n of an approximation equation of the correction characteristic is a'n=(Y'eos/Yeos) *an, approximates the correction characteristic by an approximation equation Y'=a'nXn, and changes the frequency of the write clock by a'n.

4. The image forming apparatus according to claim 1, further comprising an image former that executes image formation with a plurality of color materials respectively having different colors, wherein the hardware processor obtains the correction characteristic simultaneously in a plurality of colors used for image formation.

5. The image forming apparatus according to claim 1, wherein the hardware processor obtains the correction characteristic when the image forming apparatus is powered on.

6. The image forming apparatus according to claim 1, wherein the hardware processor obtains the correction characteristic when a difference between the first jitter information and the second jitter information exceeds a predetermined threshold.

7. A non-transitory recording medium storing a computer readable image forming control program that controls an image forming apparatus, wherein the image forming apparatus comprises:

an image carrier exposed by a light beam to form an image on the image carrier;

a light source that generates the light beam emitted in accordance with image data in synchronization with a write clock;

an optical scanner that executes scanning of the light beam in a main scanning direction on the image carrier by a plurality of reflection surfaces of a rotary polygon mirror rotationally driven by a rotary drive source;

a reflection surface identifier that identifies each of the reflection surfaces of the rotary polygon mirror;

a sub-scanning direction driver that relatively moves the image carrier and the light beam to each other in a sub-scanning direction orthogonal to the main scanning direction;

a storage that stores a first jitter information of the light beam obtained by a measurement device before execution of a print job, wherein the first jitter information corresponds to a first scanning time up to each of a plurality of positions in the main scanning direction on each of the reflection surfaces of the rotary polygon mirror;

a photodetector that detects scanning of the light beam at a start position and an end position in the main scanning direction; and a hardware processor that:

generates a second jitter information based on a detection result of the photodetector after a start of the execution of the print job, wherein the second jitter information corresponds to a second scanning time from the start position to the end position in the main scanning direction on each of the reflection surfaces of the rotary polygon mirror, corrects the first jitter information based on a difference between the first jitter information and the second jitter information at an end of each of the reflection surfaces to obtain a correction characteristic for a dot position shift on each of the reflection surfaces of the rotary polygon mirror; and changes the frequency of the write clock and adjusts the phase of the write clock based on the correction characteristic.

8. A non-transitory recording medium storing a computer readable image forming control program that controls an image forming apparatus, wherein the image forming apparatus comprising:

an image carrier exposed by a light beam to form an image on the image carrier;

a light source that generates the light beam emitted in accordance with image data in synchronization with a write clock;

an optical scanner that executes scanning of the light beam in a main scanning direction on the image carrier by a plurality of reflection surfaces of a rotary polygon mirror rotationally driven by a rotary drive source;

a reflection surface identifier that identifies each of the reflection surfaces of the rotary polygon mirror;

a sub-scanning direction driver that relatively moves the image carrier and the light beam to each other in a sub-scanning direction orthogonal to the main scanning direction;

a storage that stores a first jitter information of the light beam obtained by a measurement device before execution of a print job, wherein the first jitter information corresponds to a first scanning time up to each of a plurality of positions in the main scanning direction on each of the reflection surfaces of the rotary polygon mirror;

a photodetector that detects scanning of the light beam at a start position and an end position in the main scanning direction; and a hardware processor that:

generates a second jitter information based on a detection result of the photodetector after a start of the execution of the print job, wherein the second jitter information corresponds to a second scanning time from the start position to the end position in the main scanning direction on each of the reflection surfaces of the rotary polygon mirror, corrects the first jitter information based on a difference between the first jitter information and the second jitter information at an end of each of the reflection surfaces to obtain a correction characteristic for a dot position shift on each of the reflection surfaces of the rotary polygon mirror, and changes the frequency of the write clock based on the correction characteristic;

when a position in the main scanning direction is Xn, a dot position shift is Yn, and a slope an at each of n positions Xn in the main scanning direction is an =(Xn+1−Yn)/(Xn+1−Xn), approximates a position shift based on the first jitter information by an approximation equation Yn =anXn; and when a dot position shift according to the first jitter information at an end position Xeos in the main scanning direction is Yeos, a dot position shift according to the second jitter information at the end position Xeos in the main scanning direction is Y'eos, and a slope a'n of an approximation equation of the correction characteristic is a'n =(Y'eos/Yeos) *an, approximates the correction characteristic by an approximation equation Y'=a'nXn, and changes the frequency of the write clock by a'n.

9. The image forming apparatus according to claim 3, further comprising:

an image former that executes image formation with a plurality of color materials respectively having different colors, wherein the hardware processor obtains the correction characteristic simultaneously in a plurality of colors used for image formation.

10. The image forming apparatus according to claim 3, wherein the hardware processor obtains the correction characteristic when the image forming apparatus is powered on.

11. The image forming apparatus according to claim 3, wherein the hardware processor obtains the correction characteristic when a difference between the first jitter information and the second jitter information exceeds a predetermined threshold.

* * * * *